US011859465B2

(12) United States Patent
Al-Johar et al.

(10) Patent No.: US 11,859,465 B2
(45) Date of Patent: Jan. 2, 2024

(54) CEMENT TOP JOB WITH NON-RETRIEVABLE TUBING

(71) Applicant: SAUDI ARABIAN OIL COMPANY, Dhahran (SA)

(72) Inventors: Abdulwahab S. Al-Johar, Dhahran (SA); Abdullah Saleh Al-Yami, Dhahran (SA); Abdulla F. Dossary, Dhahran (SA); Sara A. Alkhalaf, Alkhobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/643,196

(22) Filed: Dec. 8, 2021

(65) Prior Publication Data

US 2023/0175348 A1 Jun. 8, 2023

(51) Int. Cl.

| | |
|---|---|
| ***E21B 33/14*** | (2006.01) |
| ***E21B 34/06*** | (2006.01) |
| ***E21B 23/01*** | (2006.01) |
| ***E21B 33/136*** | (2006.01) |

(52) U.S. Cl.

CPC ..... *E21B 33/14* (2013.01); *E21B 23/01* (2013.01); *E21B 33/136* (2013.01); *E21B 34/06* (2013.01)

(58) Field of Classification Search

CPC ..... E21B 17/1028; E21B 33/05; E21B 33/14; E21B 23/01; E21B 33/136; E21B 34/06

See application file for complete search history.

(56) References Cited

U.S. PATENT DOCUMENTS

| | | | | |
|---|---|---|---|---|
| 2,187,480 | A | 1/1940 | Baker | |
| 2,187,483 | A | 1/1940 | Baker | |
| 2,431,751 | A | 12/1947 | Hayward | |
| 3,001,585 | A | 9/1961 | Shiplet | |
| 4,469,174 | A * | 9/1984 | Freeman | E21B 33/14 166/317 |
| 5,494,107 | A * | 2/1996 | Bode | E21B 33/14 166/323 |
| 8,342,243 | B2 | 1/2013 | Esmail | |
| 9,038,720 | B2 | 5/2015 | Esmail | |
| 2021/0355783 | A1 * | 11/2021 | Alshalan | E21B 33/16 |

* cited by examiner

*Primary Examiner* — Yong-Suk (Philip) Ro

(74) *Attorney, Agent, or Firm* — Osha Bergman Watanabe & Burton LLP

(57) ABSTRACT

A method for cementing a wellbore having a lost circulation zone includes installing a cement basket around a casing string having a casing diameter, and running and setting the casing string in the wellbore. The cement basket is set in proximity of and up hole from the lost circulation zone. The method includes pumping a cement slurry, through the casing string, to a first depth downhole from the cement basket, running a first tubing, having a tubing diameter, into an annulus between the casing string and the wellbore, and pumping the cement slurry, through the first tubing, to a second depth up hole from the cement basket. The tubing diameter is less than the casing diameter.

20 Claims, 4 Drawing Sheets

CEMENT TOP JOB WITH NON-RETRIEVABLE TUBING

BACKGROUND

In the oil and gas industry, hydrocarbons are located in porous formations far beneath the Earth's surface. Wells are drilled into these formations to access and produce said hydrocarbons. A well includes at least one hole drilled into the Earth's surface and at least one casing string cemented in place in the hole. When a casing string is cemented in place, cement is pumped through the inside of the casing string and up into the annulus located between the casing string and the wellbore wall. The cement bonds to both the casing string and the wellbore wall to hold the casing string in place and to prevent formation fluids from migrating through the annulus.

A successful cement job occurs when the cement has reached a pre-determined height in the annulus and the cement has properly set. When the cement fails to reach the pre-determined height in the annulus, a remedial cement job such as a top job or a perf-and-squeeze job may be performed to rectify the cement placement. A top job includes pumping cement directly down the annulus to fill the space in the annulus that the initial cement job failed to fill. Current practices of performing a top job do not provide a way to properly displace the fluid, previously located in the annulus, with the cement. As such, the cement mixes with the fluid. This prevents the cement from properly setting and bonding with the casing string and the wellbore wall.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for cementing a wellbore having a lost circulation zone. In one aspect, the method includes installing a cement basket around a casing string having a casing diameter, running and setting the casing string in the wellbore, where the cement basket is set in proximity of and up hole from the lost circulation zone, pumping a cement slurry, through the casing string, to a first depth downhole from the cement basket, running a first tubing, having a tubing diameter, into an annulus between the casing string and the wellbore, where the tubing diameter is less than the casing diameter, and pumping the cement slurry, through the first tubing, to a second depth up hole from the cement basket. In one aspect, the system includes a casing string, a cement basket, and a first tubing. The casing string has a casing diameter and is disposed in the wellbore. The cement basket is connected to an outer circumferential surface of the casing string and is disposed within an annulus created between the wellbore and the outer circumferential surface of the casing string. The cement basket is configured to hold a cement slurry. The first tubing has a tubing diameter. The tubing diameter is smaller than the casing diameter. The first tubing is disposed within the annulus.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
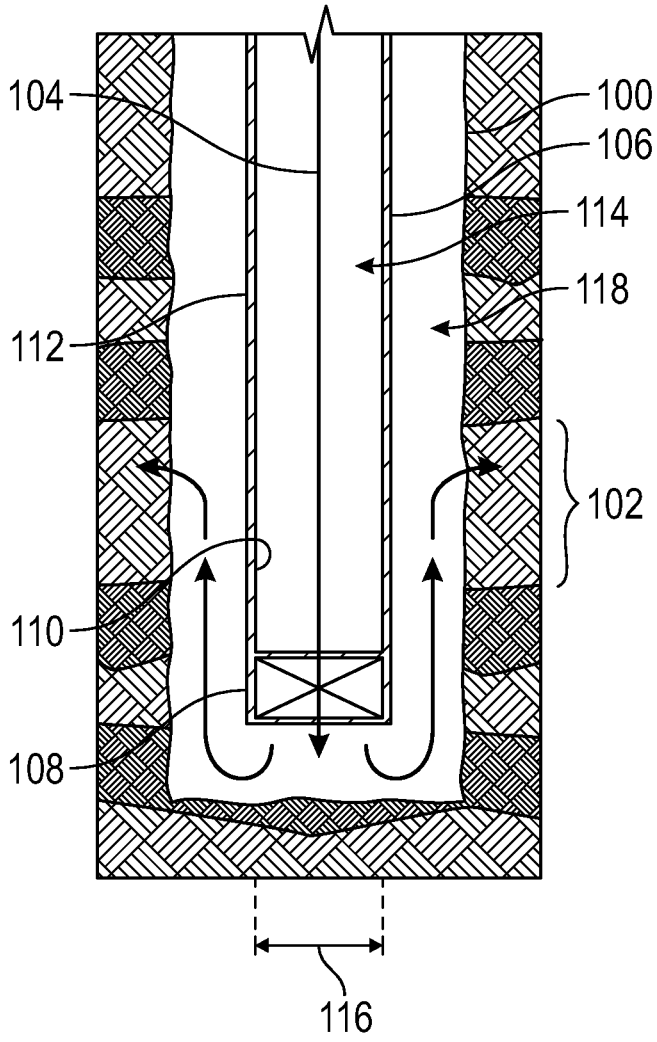
FIG. 1 shows a conventional cementing system in accordance with one or more embodiments.

FIG. 1 shows a conventional cementing system in accordance with one or more embodiments. Specifically, FIG. 1 shows a wellbore (100) drilled into the Earths surface. The wellbore (100) traverses a lost circulation zone (102). A lost circulation zone (102) is a section of an underground formation where drilling fluid or cement (104) is lost to the formation. A lost circulation zone (102) may have partial lost circulation or total lost circulation. Partial lost circulation is when only some of the drilling fluid or cement (104) is lost to the formation. Total lost circulation is when all of the drilling fluid or cement (104) is lost to the formation.

A lost circulation zone (102) may be a formation that is inherently fractured, cavernous, or has high permeability. A lost circulation zone (102) may also be a formation that has a lower fracture pressure than the surrounding formations. Thus, when this particular formation is being drilled with a mud heavier than the fracture pressure, or when the equivalent circulation density of the cement surpasses the fracture pressure, the formation is fractured and becomes a lost circulation zone (102).

A casing string (106) has been run into the wellbore (100). The casing string (106) may be the only casing string (106) planned for the well, or the casing string (106) may be one of many casing strings (106) in the well/planned for the well without departing from the scope of this disclosure herein. The casing string (106) is made of a plurality of large diameter pipe threaded together. The casing string (106) may be made out of a material that can withstand downhole conditions, such as steel. The downhole portion of the casing string (106) may have a float shoe (108) and/or a float collar (not pictured). The float shoe (108) may include a one-way valve and a seat for one or more cement wiper plugs. The float shoe (108) may also have a rounded profile that aids in protecting the casing string (106) and running the casing string (106) to bottom.

The casing string (106) has an inner circumferential surface (110) and an outer circumferential surface (112). The inner circumferential surface (110) defines a conduit (114). The inner circumferential surface (110) also defines the casing diameter (116). The space between the outer circumferential surface (112) and the wellbore (100) is the annulus (118). Cement (104) is pumped from a surface location (not pictured), downhole through the conduit (114) of the casing string (106), out of the float shoe (108), and up hole into the annulus (118). However, the cement (104) is unable to reach a pre-determined height in the annulus (118) due to the lost circulation zone (102). The cement (104) is only able to fill the annulus (118) up to the lost circulation zone (102), as the cement (104) reaches the lost circulation zone (102), the cement (104) is lost to the lost circulation zone (102). As such, a top job must be performed to fill the required space in the annulus (118) with cement (104).

Conventional methods of performing a top job includes pumping cement (104) directly downhole through the annulus (118). This practice does not provide a way to properly displace the fluid, previously located in the annulus (118), with the cement (104). This contaminates the cement (104) and prevents the cement (104) from properly setting and bonding with the casing string (106) and the wellbore (100). Therefore, methods and systems that allow for cement (104) to be placed in an annulus (118) while circumventing the lost circulation zone (102) and displacing the fluid in the annulus (118) are beneficial. As such, embodiments presented herein describe methods and systems for a two-stage cement job that uses non-retrievable tubing to pump cement (104) into the annulus (118).

Figure 2B:
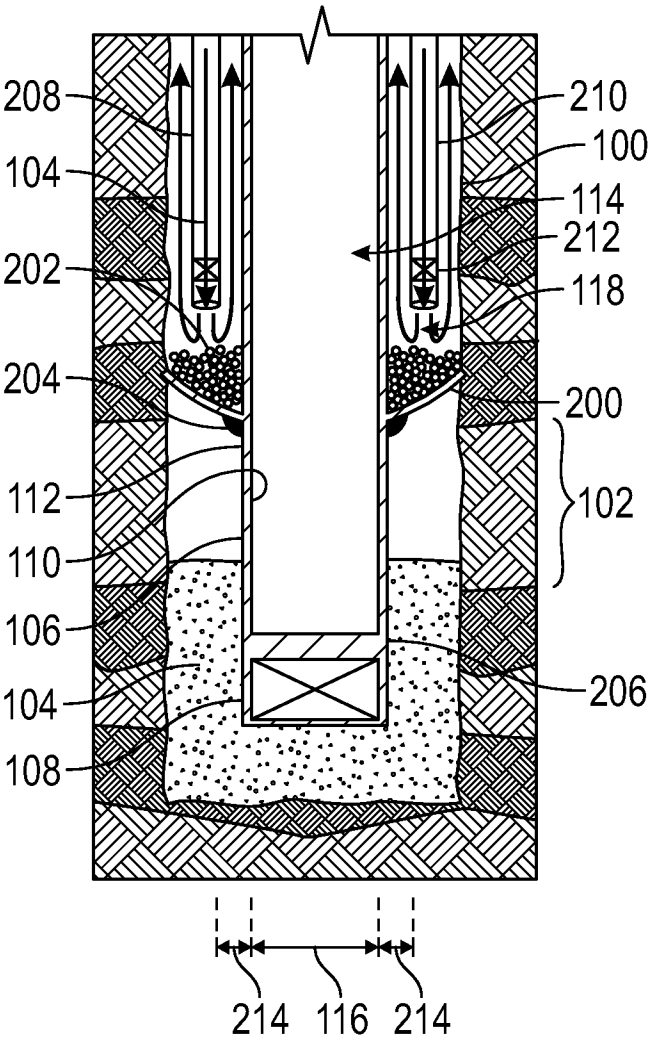
FIGS. 2*a* and 2*b* show a two-stage cement job in accordance with one or more embodiments.
Figure 2A:
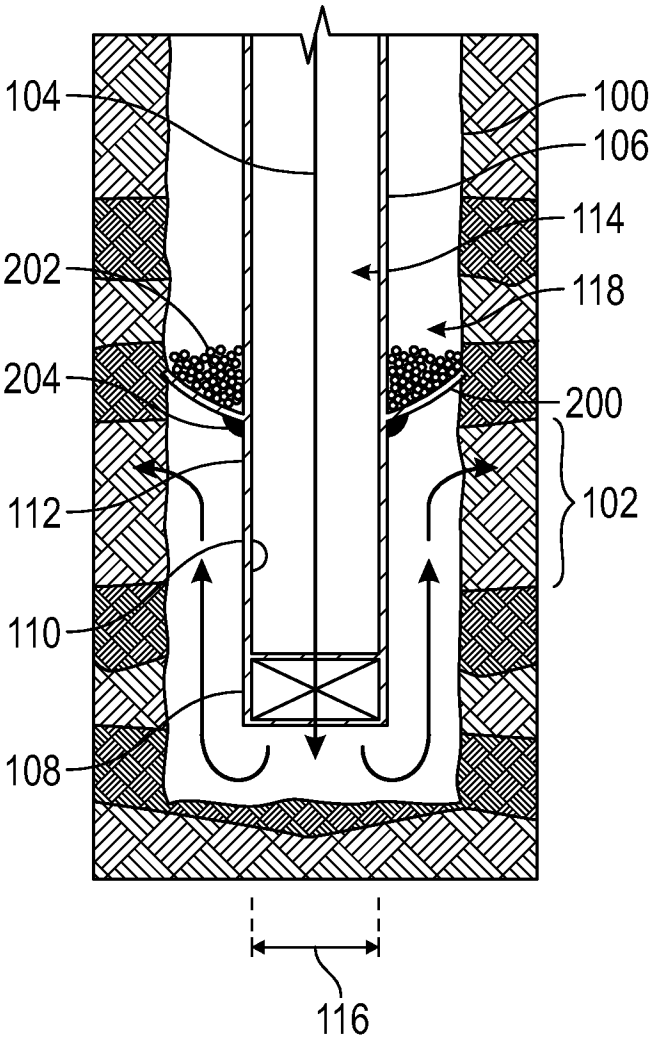

FIGS. 2*a* and 2*b* show a two-stage cement job in accordance with one or more embodiments. Components in FIGS. 2*a* and 2*b* that are the same as or similar to components presented in FIG. 1 have not been redescribed for purposes of readability and have the same function and description as outlined above. Specifically, FIG. 2*a* shows the system of FIG. 1 undergoing the first stage of the cement job and FIG. 2*b* shows the system of FIG. 1 undergoing the second stage of the cement job.

A cement basket (200) is connected to the outer circumferential surface (112) of the casing string (106). The cement basket (200) may be welded to or latched around the outer circumferential surface (112) of the casing string (106). Further, the cement basket (200) may be anchored to the outer circumferential surface (112) using one or more anchors (204). As shown in FIGS. 2*a* and 2*b*, the anchors (204) may be pieces of metal welded to the casing string (106) and the cement basket (200). In one or more embodiments, the anchors (204) may be formed in a tapered shape, that is, wider near the cement basket (200) and thinner near the casing string (106). In one or more embodiments, the anchor (204) may be a single metal ring welded between the cement basket (200) and the casing string (106). The anchors (204) are used to support the cement basket (200) from breaking down under the weight of the cement (104) slurry. In one or more embodiments, there may be a plurality of anchors (204), e.g., 4 to 6 anchors, connected to each cement basket (200).

In one or more embodiments, a secondary cement basket may be nested within the first cement basket (200) to provide additional support. A cement basket (200) is an apparatus well known in the art that is configured to hold a slurry of cement (104). The cement basket (200) may be made out of overlapping metal fins that are flexible and form a bi-frustoconical shape. A fabric covering may be located within the cement basket (200) to cover the openings between the overlapping metal fins. The cement basket (200) is sized to bridge the space in the annulus (118). The cement basket (200) is installed at a location along the casing string (106) such that, when the entire casing string (106) is run in the wellbore (100), the cement basket (200) is disposed within the annulus (118) and located in proximity of and up hole from the lost circulation zone (102).

Gravel (202) may be located within the cement basket (200). The gravel (202) may be placed in the cement basket (200) when the casing string (106) is at the surface. The individual rocks used in the gravel (202) may have different diameters to bridge the gaps between each rock. The gravel (202) prevents the cement slurry from passing through the cement basket (200) to the lost circulation zone (102).

The first stage of the two-stage cement job is shown in FIG. 2*a*. The first stage starts with performing a normal cement job as explained in FIG. 1. Cement (104) is pumped from a surface location downhole through the conduit (114) of the casing string (106). The cement is pumped out of the float shoe (108) and up hole through the annulus (118). The cement (104) is pumped to the lost circulation zone (102) in the annulus (118). A wiper plug (206) may be pumped downhole through the conduit (114) of the annulus (118) to displace the cement (104) into the annulus (118) and wipe the inner circumferential surface (110) of cement (104). The wiper plug (206) may land in a seat in the float shoe (108) to conclude the first stage of the cement job.

FIG. 2*b* shows the planned top of cement (104) from the first stage. FIG. 2*b* also shows the second stage of the cement job. A first tubing (208) is run into the annulus (118) between the outer circumferential surface (112) of the casing string (106) and the wellbore (100). A second tubing (210) may also be run into the annulus (118). The first tubing (208) and the second tubing (210) have a tubing diameter (214). The tubing diameter (214) is smaller than the casing diameter (116). The first tubing (208) and the second tubing (210) are made of a plurality of tubulars made out of s material that is able to withstand downhole conditions. The tubulars may be welded or threaded together to create the first tubing (208) and the second tubing (210).

The first tubing (208) and the second tubing (210) may each have a one-way valve (212). The one-way valve (212) allows fluid to flow downhole through the first tubing (208) and the second tubing (210) and prevents fluid from flowing up hole through the first tubing (208) and the second tubing (210). The first tubing (208) and the second tubing (210) may each have a surface valve (not pictured) located on the surface-extending portion of the first tubing (208) and the second tubing (210). The surface valve allows and stops flow into the first tubing (208) and the second tubing (210).

Cement lines (not pictured) may be connected to the first tubing (208) and the second tubing (210) using a union valve (not pictured).

The first tubing (208) and the second tubing (210) are run into the annulus (118) to a depth proximate the cement basket (200). Cement (104) may be pumped into both the first tubing (208) and the second tubing (210), or cement may be pumped into only one tubing leaving the other as a backup. As shown in FIG. 2*b*, the cement (104) is pumped downhole through the first tubing (208) and the second tubing (210). The cement (104) exits the first tubing (208) and the second tubing (210) into the annulus (118). The cement basket (200) and gravel (202) prevent the cement (104) from entering the lost circulation zone (102). The cement (104) is pumped up hole in the annulus (118) to the pre-determined height.

In one or more embodiments, the cement (104) is pumped into the annulus (118) until clean cement (i.e., cement not contaminated with other fluids) is seen at the surface. Further, water or another fluid may be pumped into the first tubing (208) and the second tubing (210) to flush the tubing of cement (104). This allows the first tubing (208) and the second tubing (210) to be used in future remedial cementing operations. The first tubing (208) and the second tubing (210) are left in the annulus (118) as the cement (104) sets.

Figure 3B:
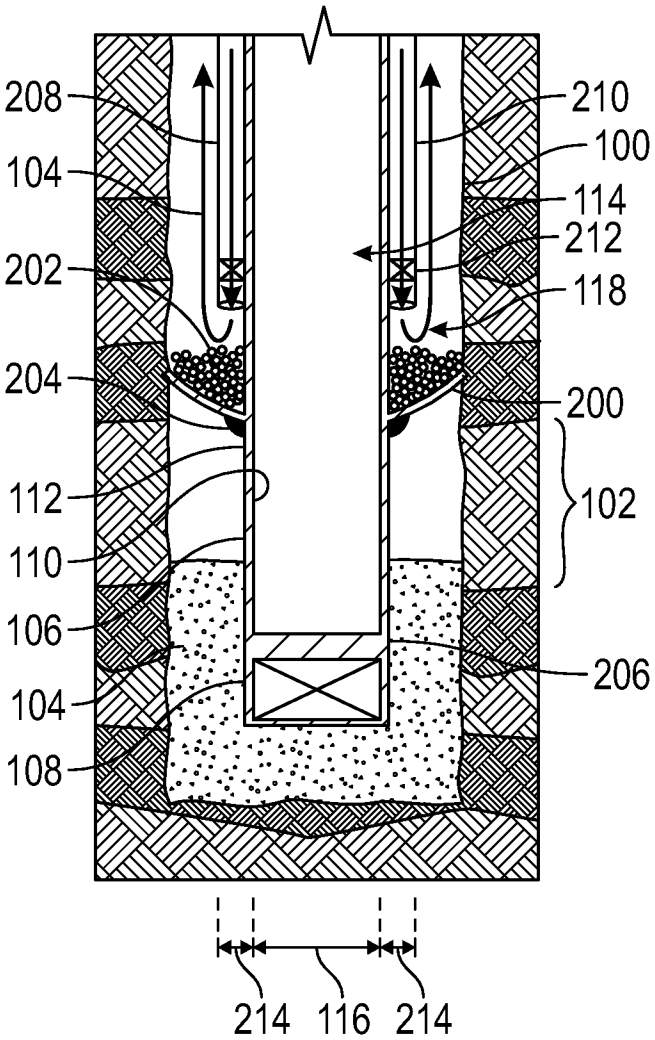
FIGS. 3*a* and 3*b* show a two-stage cement job in accordance with one or more embodiments.
Figure 3A:
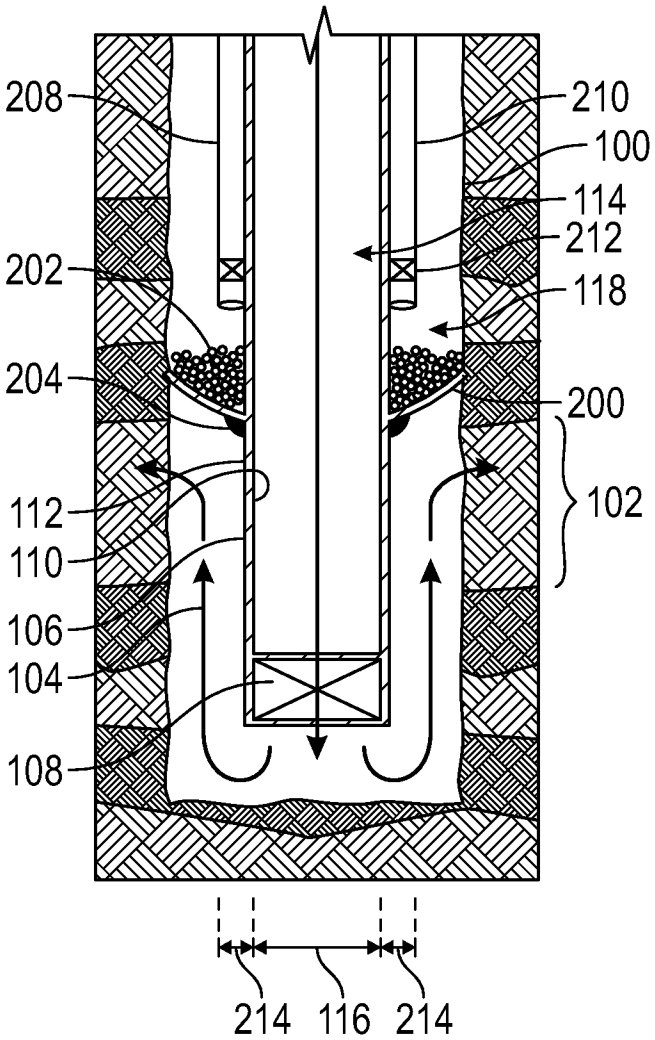

FIGS. 3*a* and 3*b* show a two-stage cement job in accordance with one or more embodiments. Components in FIGS. 3*a* and 3*b* that are the same as or similar to components presented in FIGS. 1-2*b* have not been redescribed for purposes of readability and have the same function and description as outlined above. Specifically, FIG. 3*a* shows the system of FIG. 1 undergoing the first stage of the cement job and FIG. 3*b* shows the system of FIG. 1 undergoing the second stage of the cement job.

As in FIGS. 2*a* and 2*b*, a cement basket (200) has been installed on the casing string (106) with at least one anchor (204). However, as the casing string (106) was run into the wellbore (100), the first tubing (208) and the second tubing (210) were connected to the casing string (106) and also run into the wellbore (100) at the same time. The first tubing (208) and the second tubing (210) may be connected to the casing string (106) by welding the first tubing (208) and the second tubing (210) to the outer circumferential surface (112) of the casing string (106) or by coupling the first tubing (208) and the second tubing (210) to the outer circumferential surface (112) of the casing string (106). FIG. 3*a* shows the first stage of the two-stage cement job performed similar to the first stage performed in FIG. 2*a*. FIG. 3*b* shows the second stage of the two-stage cement job performed similar to the second stage performed in FIG. 2*b*.

Figure 4:
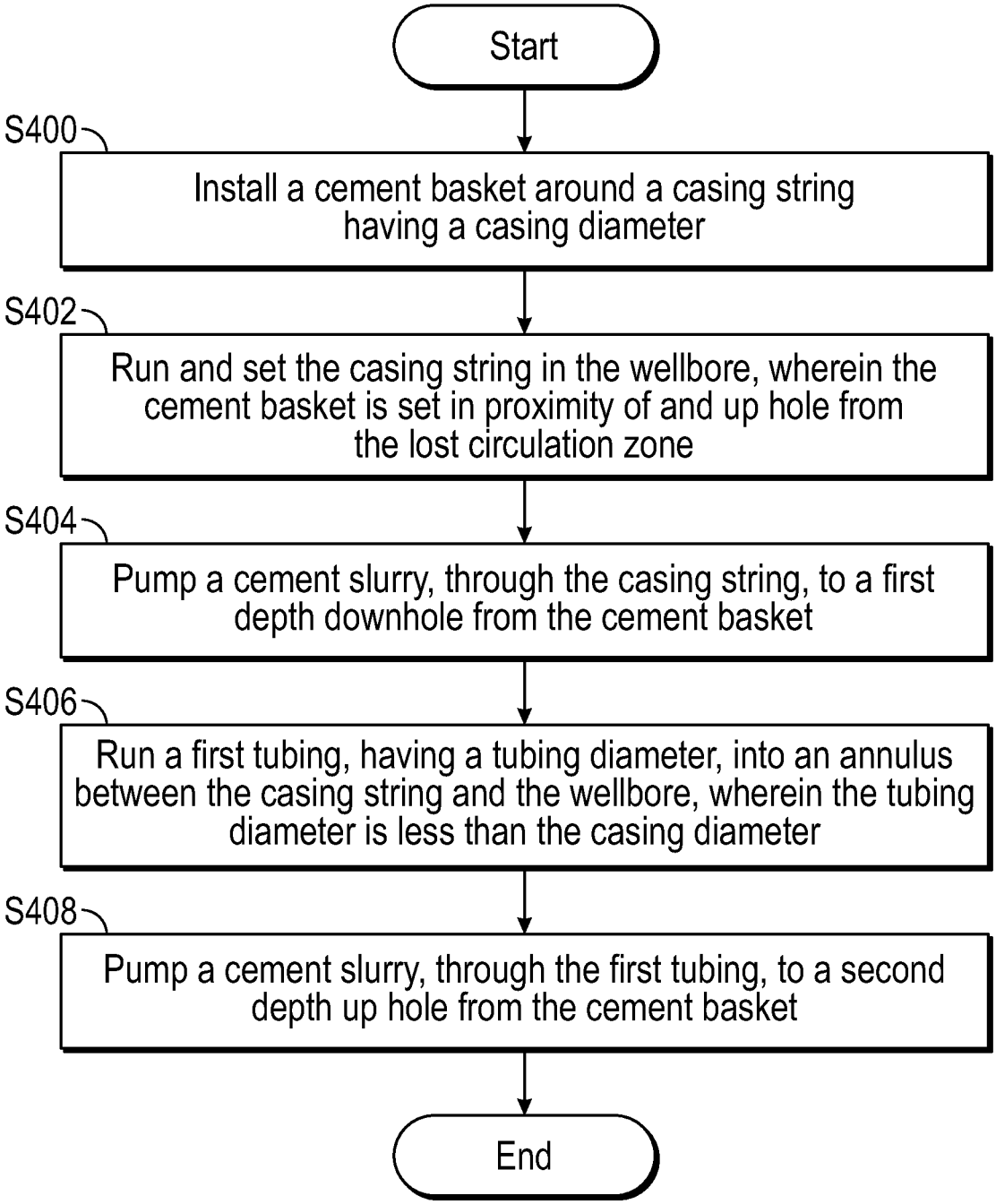
FIG. 4 shows a flowchart in accordance with one or more embodiments.

FIG. 4 shows a flowchart in accordance with one or more embodiments. The flowchart outlines a method for cementing a wellbore (100) having a lost circulation zone (102). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a cement basket (200) is installed around a casing string (106) having a casing diameter (116) (S400). A secondary cement basket (200) may also be installed and nested within the first cement basket (200). At least one anchor (204) may be fastened to the cement basket (200) and the casing string (106) to support the cement basket (200). In one or more embodiments, 4-6 anchors are fastened to the cement basket (200) and the casing string (106). In other embodiments, more than two cement baskets (200) may be used in tandem to provide further support. Gravel (202) is located within the cement basket (200) to prevent cement (104) from migrating through the cement basket (200). The cement basket (200) may be filled with gravel (202) when the cement basket (200) is installed to the casing string (106) at the surface.

The casing string (106) is run and set in the wellbore (100). The cement basket (200) is set in proximity of and up hole from the lost circulation zone (102) (S402). A cement (104) slurry is pumped, through the casing string (106), to a first depth downhole from the cement basket (200) (S404). The first depth may be located directly downhole from the lost circulation zone (102). A volume of cement may be pumped into or up hole from the lost circulation zone (102) without departing from the scope of the disclosure herein. A first tubing (208), having a tubing diameter (214), is run into an annulus (118) between the casing string (106) and the wellbore (100), wherein the tubing diameter (214) is less than the casing diameter (116) (S406).

A second tubing (210), having the tubing diameter (214), may also be run into the annulus (118). The first tubing (208) and the second tubing (210) may be run into the annulus (118) after the casing string (106) has been run in the wellbore (100), or the first tubing (208) and the second tubing (210) may be connected to the casing string (106) as the casing string (106) is run into the wellbore (100). The first tubing (208) and the second tubing (210) may be connected to the casing string (106) by welding the first tubing (208) and the second tubing (210) to the casing string (106). The cement (104) slurry is pumped, through the first tubing (208), to a second depth up hole from the cement basket (200) (S408). The cement (104) slurry may also be pumped through the second tubing (210) to the second depth. In one or more embodiments, the second depth is at the surface. That is, the cement (104) is pumped into the annulus (118) until cement (104) is seen at the surface.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for cementing a wellbore having a lost circulation zone, the method comprising:

installing a cement basket around a casing string having a casing diameter;

running and setting the casing string in the wellbore, wherein the cement basket is set in proximity of and up hole from the lost circulation zone;

pumping a cement slurry, through the casing string, to a first depth downhole from the cement basket;

running a first tubing, having a tubing diameter, into an annulus between the casing string and the wellbore, wherein the tubing diameter is less than the casing diameter and the first tubing is run to a depth in the annulus proximate the cement basket; and pumping the cement slurry, through the first tubing, to a second depth up hole from the cement basket.

2. The method of claim 1, further comprising running a second tubing, having the tubing diameter, into the annulus between the casing string and the wellbore.

3. The method of claim 2, wherein running the first tubing and the second tubing into the annulus between the casing string and the wellbore comprises connecting the first tubing and the second tubing to an outer circumferential surface of the casing string.

4. The method of claim 3, wherein connecting the first tubing and the second tubing to the outer circumferential surface of the casing string comprises welding the first tubing and the second tubing to the outer circumferential surface of the casing string.

5. The method of claim 4, wherein the first tubing and the second tubing each comprise a one-way valve and a surface valve.

6. The method of claim 1, wherein running the first tubing into the annulus between the casing string and the wellbore comprises connecting the first tubing to an outer circumferential surface of the casing string.

7. The method of claim 1, wherein the first tubing comprises a one-way valve and a surface valve.

8. The method of claim 1, wherein installing the cement basket around the casing string comprises fastening an anchor to the cement basket and the casing string to support the cement basket.

9. The method of claim 1, wherein installing the cement basket around the casing string comprises filling the cement basket with gravel.

10. The method of claim 1, wherein installing the cement basket around the casing string comprises installing a secondary cement basket around the casing string.

11. A system for a wellbore having a lost circulation zone, the system comprising:

a casing string, having a casing diameter, disposed within the wellbore;

a cement basket connected to an outer circumferential surface of the casing string and disposed within an annulus created between the wellbore and the outer circumferential surface of the casing string, wherein the cement basket is configured to hold a cement slurry; and a first tubing, having a tubing diameter, disposed within the annulus at a depth proximate the cement basket, wherein the tubing diameter is smaller than the casing diameter, and wherein the cement slurry pumped through the casing string and the first tubing.

12. The system of claim 11, further comprising a second tubing, having the tubing diameter, disposed within the annulus.

13. The system of claim 12, wherein the first tubing and the second tubing are connected to the outer circumferential surface of the casing string.

14. The system of claim 13, wherein the first tubing and the second tubing are welded to the outer circumferential surface of the casing string.

15. The system of claim 14, wherein the first tubing and the second tubing each comprise a one-way valve and a surface valve.

16. The system of claim 11, wherein the first tubing is connected to the outer circumferential surface of the casing string.

17. The system of claim 11, wherein the first tubing comprises a one-way valve and a surface valve.

18. The system of claim 11, further comprising an anchor connected to both the cement basket and the casing string to provide support for the cement basket.

19. The system of claim 11, further comprising gravel located within the cement basket.

20. The system of claim 11, further comprising a secondary cement basket disposed around the casing string.

* * * * *